United States Patent [19]

Campbell

[11] Patent Number: 4,756,486

[45] Date of Patent: Jul. 12, 1988

[54] SCUBA DIVING REEL

[76] Inventor: Timothy A. Campbell, 1704 S. Sheridan, Bay City, Mich. 48706

[21] Appl. No.: 875,205

[22] Filed: Jun. 17, 1986

[51] Int. Cl.[4] ..... B65H 54/02; B65H 59/00

[52] U.S. Cl. ..... 242/84.1 N; 242/84.5 R; 242/96; 242/99; 242/156

[58] Field of Search ..... 242/84.1 F, 84.1 N, 242/84.5 R, 96, 99, 104, 156, 156.2

[56] References Cited

U.S. PATENT DOCUMENTS

| | | | |
|---|---|---|---|
| 1,976,242 | 10/1934 | McGee | 242/99 |
| 1,996,697 | 4/1935 | Cumings | 242/84.5 R |
| 2,051,259 | 8/1936 | James | 242/84.1 F |
| 2,230,940 | 2/1941 | Ellsworth | 242/84.1 K |
| 2,896,878 | 7/1959 | Wetzel | 242/99 |
| 3,090,577 | 5/1963 | Lewandowski | 242/96 |
| 3,705,697 | 12/1972 | Chagnon | 242/96 |
| 3,784,124 | 1/1974 | Shumato et al. | 242/84.5 R |
| 3,901,458 | 8/1975 | Kuncz | 242/96 |

*Primary Examiner*—David Werner

*Attorney, Agent, or Firm*—John J. Swartz

[57] ABSTRACT

A scuba diving reel comprising a hand held frame rotatably mounting a line receiving spool on which a length of line is wound. A coupling member is provided on the terminal end of the line for attaching the line to an object such as a buoy so that when the scuba diver moves away from the buoy, the spool will rotate and pay out line. Anti-backlash mechanism is provided for preventing the freewheeling of the spool when tension force thereon is removed. Rotatable pinch mechanism is provided for maintaining taut the line portion between the pinch mechanism and the spool.

18 Claims, 2 Drawing Sheets

SCUBA DIVING REEL

BACKGROUND OF THE INVENTION

1. Field of the Invention

This invention relates to a reel, particularly adapted for use by scuba divers, having a rotatable spool upon which is wound a length of line that has a free end for attaching a buoy or the like, and more particularly to a reel construction construction which will minimize line backlash, when the line is paid out, but which will allow the line to be maintained taut while the line is being wound onto the reel spool.

2. Description of the Prior Art

Scuba divers frequently enter underwater caves, sunken ships, and the like wherein it is important that they be able to retrace their path so as to successfully exit the underwater object being inspected. It has been found convenient to attach one end of a line to an object such as a floating buoy while the opposite end of the line is carried by the scuba diver.

It has been found desirable to have the line wound on a reel spool which will pay out the line as the diver moves away from the buoy. Accordingly, it is an object of the present invention to provide a new and novel reel for use in scuba diving or the like.

It is important that the line not be tangled and thus important to provide a reel with mechanism which will prevent backlash when the reel stops turning. Accordingly, it is another object of the present invention to provide a new and novel reel of the type described including new and novel anti-backlash mechanism for preventing backlash of the line.

When a scuba diver wants to return, he need merely wind the line onto the reel to retrace his path. When tension force is removed, the line would typically tend to float upwardly and thus may not be tightly wound onto the reel. It is important that mechanism be provided to maintain the line taut as it is wound onto the reel spool. Accordingly, it is another object of the present invention to provide a reel of the type described including new and novel mechanism for maintaining the line taut as it is wound onto the reel. It is still another object to provide a scuba diving reel which includes new and novel but yet relatively simple mechanism for maintaining the line taut as it is wound on a reel spool.

When the reel is not in use, it is desirable that the reel be locked in a position to preclude the reel from inadvertently rotating and paying out line which can become tangled. Accordingly, yet another object of the present invention is to provide new and novel reel of the type described including new and novel mechanism for releasably locking the line receiving spool to prevent rotation thereof.

One scuba diving reel has been provided heretofore such as that disclosed in the U.S. Pat. No. 3,705,697, issued to Verdun P. Cagnon on Dec. 12, 1972, however, the construction is substantially different.

Various other reels have been provided heretofore of a portable nature having lines which are payed out from a rotatable reel such as those disclosed in the following U.S. Patents:

569,128 Guild Oct. 6, 1896
612,673 Reidy et al Oct. 18, 1898
3,090,577 Lewandowski Jan 31, 1963
4,106,719 Haverland Aug. 15, 1978
4,129,273 Hill Dec. 12, 1978

4,204,651 Haverland May 27, 1980

These patents are all of differing constructions.

Other objects and advantages of the present invention will become apparent to those of ordinary skill in the art as the description thereof proceeds.

SUMMARY OF INVENTION

A portable hand held reel for scuba diving and the like comprising a frame, a spool rotatably mounted on the frame, a length of line, wound on the spool, having a terminal end for attaching to an object such as a buoy or the like, such that said reel and the object are relatively moved away from each other, tension force will be exerted on the line to cause the spool to rotate in one direction, anti-backlash mechanism for preventing the free wheeling of the spool when line is not being drawn from the reel, a handle for rotating the spool in an opposite direction to wind the line on the spool, and line tensioning mechanism mounted on the frame for yieldably pinching the line to maintain the portion of the line between the pinched mechanism and spool taut when the line is wound on on the spool.

BRIEF DESCRIPTION OF THE DRAWINGS

The invention may be more readily understood by referring to the accompanying drawings in which.

DESCRIPTION OF THE PREFERRED EMBODIMENT

Figure 1:
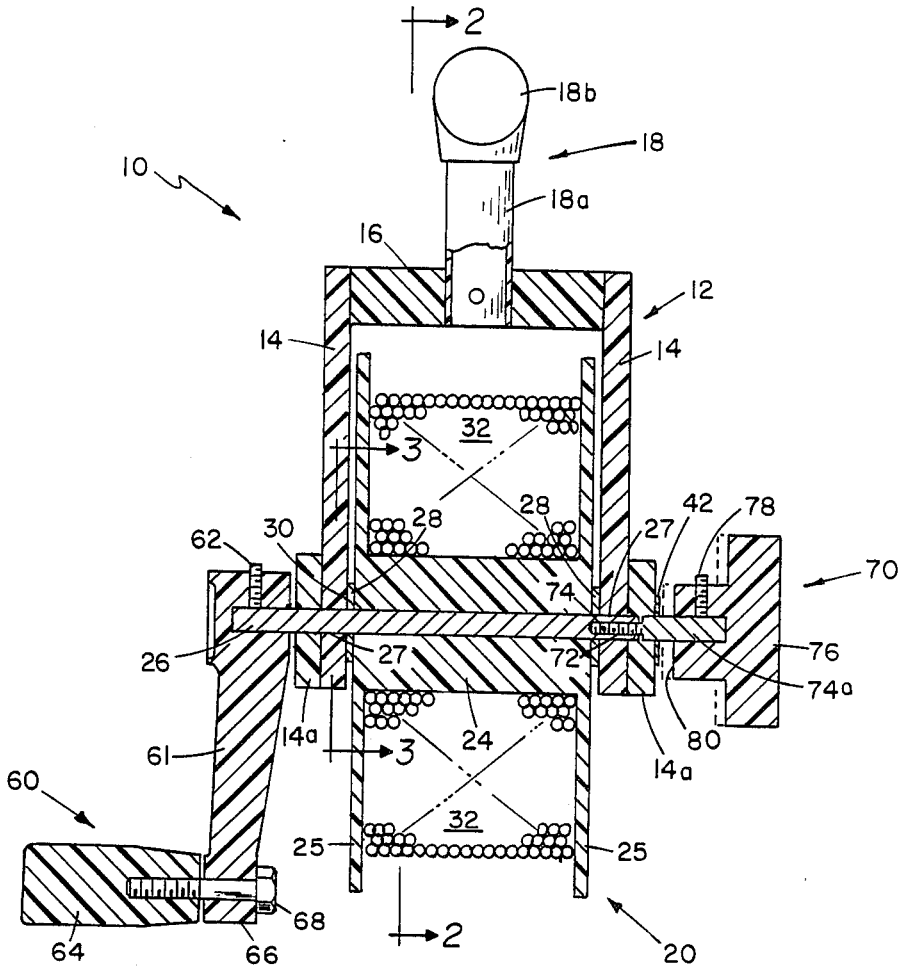
FIG. 1 is a sectional front elevational view of a reel constructed according to the present invention taken along the line 1—1 of FIG. 2.
Figure 3:
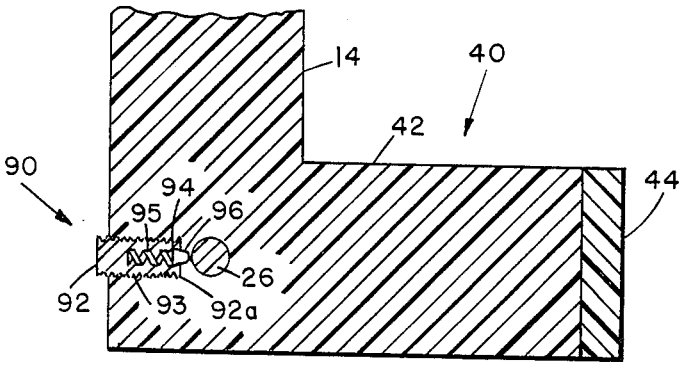
FIG. 3 is an enlarged fragmentary sectional end view, taken along the line 3—3 of FIG. 1, particularly illustrating the anti-backlash mechanism.
Figure 5:
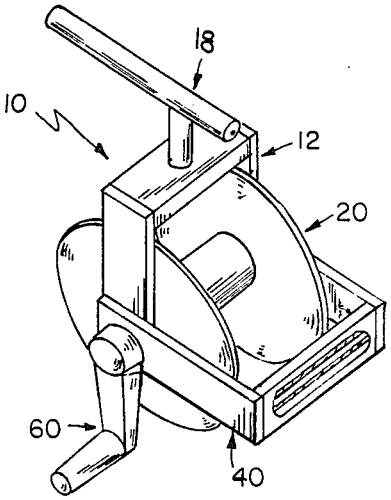
FIG. 5 is a greatly reduced perspective view of the reel illustrated in FIGS. 1-4, without the line.

Referring now more particularly to the drawings, a scuba diving reel, generally designated 10 is illustrated and includes an inverted U-shaped frame, generally designated 12, having a pair of vertical side legs 14 spanned by an upper cross frame member 16. A handle 18 is mounted on the cross frame member 16 and includes an upstanding stem **18*a* and a handle cross bar 18*b***.

A line receiving spool, generally designated 20, is provided and includes a hub 24 having a pair of integral circular end plates 25. The hub portion 24 is fixed to a shaft 26 which is journaled in apertures 27 provided in the lower ends **14*a* of the frame legs 14. Spacing washers 28 are mounted on the shaft 26 between the outside surfaces 30 of the hub 24 and the inside surfaces of the legs 14. The spool end plates 25 and the hub 24 provide an annular channel for receiving a length of line 32 having a terminal end 33 coupled to an end coupling member 34 which can be detachably connected to a floatable buoy or the like. The line 32** may suitably comprise braided material such as nylon or the like.

Fixed to the upstanding inverted U-shaped frame member 12 is a forwardly projecting U-shaped member, generally designated 40, including side leg portions 42, coupled to frame legs 14, and a forward end base member 44 having an elongated slot or aperture 46 therethrough. A pair of vertically spaced, stainless steel rollers 48 are journaled in openings 50 provided in the portions 52 of the end wall 44, adjacent the opposite ends of aperture 46. The rollers 48 cooperate to pinch and squeeze the line 32 which passes therebetween. The distance 54 between the opposing surfaces of the rollers 48 is slightly less than the diameter 56 of the line 32 so that, as the spool 20 is turned clockwisely, in the direction of the arrow 58, the rollers 48 will pinch the portion 32*a* of the line between the line tensioning rollers 48 and the spool 20 will remain taut. A handle, generally designated 60, is provided for rotating the spool 20 clockwisely, in the direction represented by arrow 58. The handle 60 includes an arm 61 fixed to the shaft 26, via a set screw 62, and a transverse, hand graspable knob portion 64 fixed to the opposite end 66 of arm 61 by a bolt 68 which is journaled on the handle arm 61.

Figure 4:
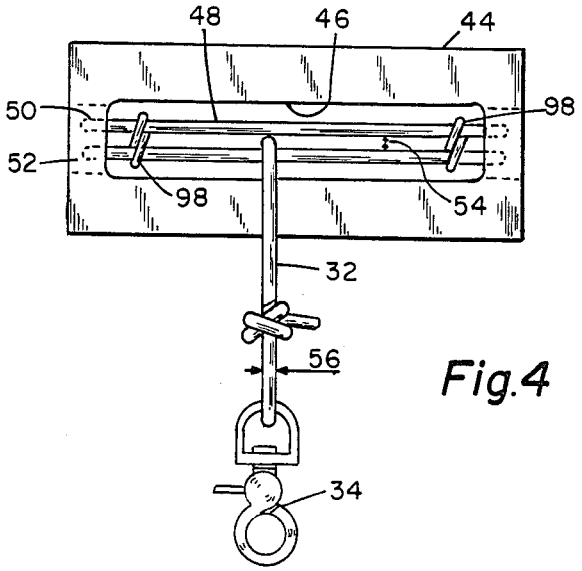
FIG. 4 is an enlarged front elevational fragmentary view, taken along the line 4—4 of FIG. 2, to more particularly illustrate the mechanism for maintaining the line taut.

A pair of endless resilient members constructed of rubber or the like, generally designated 98, is wrapped on the rollers 48 in the shape of a figure eight, as illustrated in FIG. 4, to inhibit the rotation of the rollers 48 and thus inhibit the movement of line being payed out as it moves therebetween. The resilient members 98 are placed in tension to retard the freewheeling of rollers 48.

Brake mechanism, generally designated 70, is provided for releasably locking the spool 20 in position when not in use. The brake mechanism 70 includes a threaded bolt 72 which is threadedly received in a complementary shaped, threaded opening 74 provided in the opposite end 26*b* of shaft 26. The bolt 72 includes an enlarged head 74*a* mounted on a hand actuated knob 76 via a set screw 78. When the bolt 72 and knob 76 are turned in one direction, about the axis a of the shaft 26, the knob 76 will move axially inwardly so that the knob end surface 80 bears against the outside surface of one leg 14 forcing the legs 14 to bow inwardly towards each other and clamp the spool 20 therebetween and prevent rotation thereof. When the knob 76 is turned in opposite direction, to the position illustrated in solid lines in FIG. 1, the resilient leg members 14 will return to their original position and release the spool 24 for rotation.

To preclude the spool 20 from continuing to rotate when line tension force, in the direction of the arrow B (FIG. 2) is removed, tension mechanism, generally designated 90 is provided and includes a threaded set screw 92 threadedly received in a complemental opeing 93 provided in the rearward wall of one of the legs 14. The inner end 92*a* of the set screw 92 includes an end recess 94 receiving a coil spring 95 which has a ball plunger or detent 96 fixed to the outer end thereof and projecting beyond the end of set screw 92. The plunger 96 is disposed in engagement with the outer surface of the shaft 26. The amount of force exerted by the ball plunger detent 96 on the shaft 26 can be variably increased or decreased by turning the screw 92 inwardly or outwardly respectively of the opening 93. When the screw 92 is turned outwardly so that the detent 96 is not bearing against the shaft 26, the spool 20 can rotatably free wheel about the axis a and the line can become entangled.

OPERATION

Figure 2:
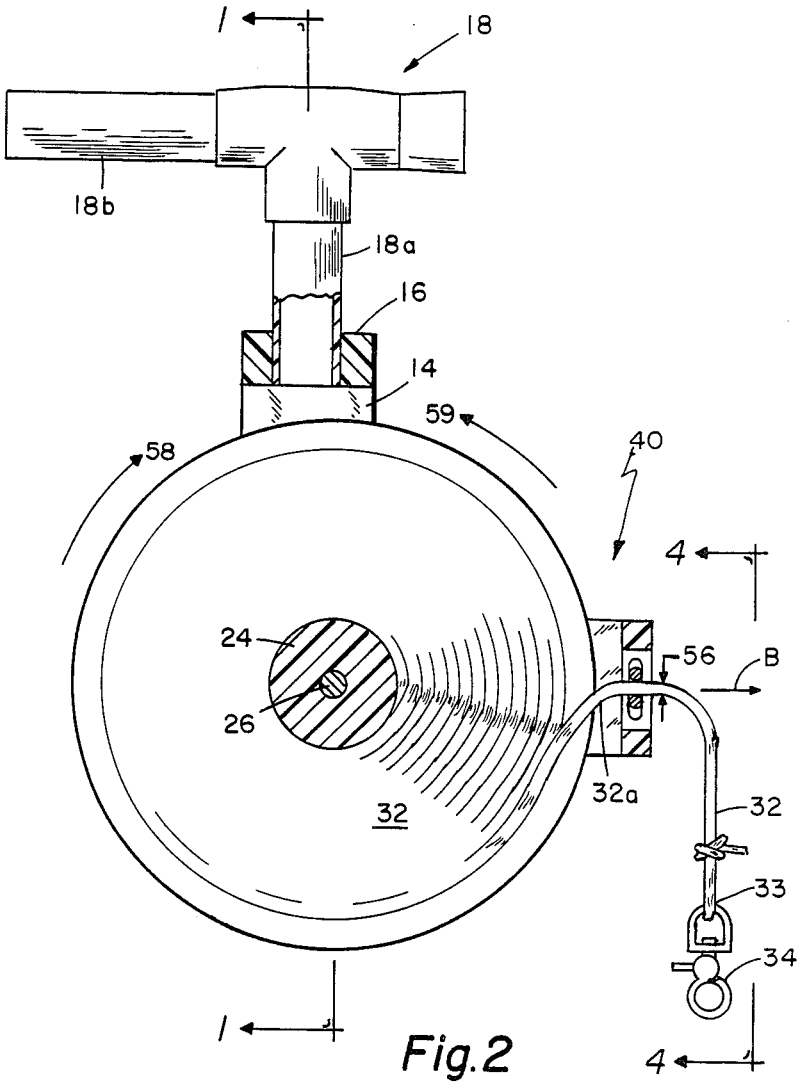
FIG. 2 is a sectional side elevational view thereof, taken along the line 2—2 of FIG. 1.

In operation, the lock or brake, generally designated 70, in unturned to the position illustrated in solid lines in FIG. 2 and the coupling member 34 is coupled to a fixed object such as a buoy, a ship, or the like.

The diver will hold the unit in his hand, via the handle 18, and as he moves away from the buoy and/or ship, the line will become taut and force exerted by the line in the direction of the arrow B (FIG. 2) will cause the spool 20 to rotate counter-clockwisely about the axis a, in the direction of the arrow 59, forcing the line to be paid out against the force of anti-backlash mechanism 90.

When the diver wants to return, he need merely turn the handle 60 and rotate the shaft 26 about its axis a, in the direction of the arrow 58, to wind the reel causing the line to be again received on the reel.

As the line is being wound in the direction of the arrow 58, the rollers 48 will maintain tension on the line portion 32*a* so that it will be tightly wound onto the reel.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A hand held portable reel for scuba diving or the like comprising:
   - a frame;
   - a spool rotatably mounted on said frame;
   - a length of line wound about said spool and having a terminal end for attaching to an object, such as a floating buoy, so that as said reel and said object are relatively moved away from each other, the line will become taut to force said reel to rotate in one direction and allow line wound on the reel to be payed out;
   - anti-backlash means on said frame for preventing free wheeling of said spool when line is not being payed out;
   - means for driving said spool in a direction opposite said one direction for winding said line on said spool;
   - line tensioning means on said frame for yieldably receiving, pinching and passing said line to maintain the portion of said line between said tensioning means and said spool taut when said spool is driven in said opposite direction but yieldable so as to allow the line to be payed out; and
   - brake means on said frame for releasably locking said spool to inhibit rotation thereof when the reel is not in use;
   - said line tensioning means comprising
     - a pair of rollers rotatably mounted on said frame for squeezing opposite sides of said line and
     - endless resilient means bearing against and reacting between said rollers for restricting the free rotation of said rollers.

2. The reel set forth in claim 1 wherein brake means is provided on said frame for releasably locking said spool to inhibit rotation thereof when the reel is not in use.

3. The reel set forth in claim 1 wherein said frame includes an aperture through which said length of line passes; said pair of rollers being disposed in said aperture.

4. The reel set forth in claim 1 including means mounting said rollers on said frame such that the distance between the confronting surfaces thereof is less than the diameter of said line.

5. A hand held portable reelf or scuba diving or the like comprising:

a frame;

a spool rotatably mounted on said frame;

a length of line of predetermined diameter wound about said spool and having a terminal end for attaching to an object, such as a floating buoy, so that as said reel and said object are relatively moved away from each other, the line will become taut to force said reel to rotate in one direction and allow line wound on the reel to be payed out;

anti-backlash means on said frame for preventing free wheeling of said spool when line is not being payed out;

means for driving said spool in a direction opposite said one direction for winding said line on said spool;

line tensioning means on said frame for yieldably receiving, pinching and passing said line to maintain the portion of said line between said tensioning means and said spool taut when said spool is driven in said opposite direction but yieldable so as to allow the line to be payed out;

said line tensioning means comprising a pair of rollers rotatably mounted on said frame including annular surfaces for squeezing opposite sides of said line; and yieldable means reacting between said rollers and bearing against said annular surfaces for restricting the free rotation of said rollers.

6. The reel set forth in claim 5 wherein said yieldable means comprises resilient means abutting said annular surfaces.

7. The reel set forth in claim 6 wherein at least a portion of said resilient means is disposed between said rollers.

8. The reel set forth in claim 6 wherein said frame includes an aperture and said rollers are disposed in said aperture.

9. The reel set forth in claim 8 further including clamp means for detachably clamping said spool to said frame including means reacting between the opposite end of said shaft and said frame.

10. The reel set forth in claim 9 wherein said clamp means comprises a screw threadedly received in said opposite end of said shaft and mount means mounting said screw for rotation about its axis between a locked position in which said mount means and said spool are tightly sandwiched against opposite side of a portion of said frame to preclude rotation of said spool and an unlocked position.

11. The reel set forth in claim 10 wherein said clamp means including means reacting between said shaft and said frame to inwardly deflect portions of said frame on opposite sides of said spool into clamping engagement with said spool.

12. The reel set forth in claim 9 wherein said frame includes opposing side portions; said spool is journaled for rotation between said opposing side portions of said frame; said clamp means comprises a screw threadedly received in said opposite end of said shaft and mount means mounting said screw for rotation about its axis between a locked position, in which said spool is tightly sandwiched between said opposing side portions of said frame, to preclude rotation of said spool, and an unlocked position.

13. The reel set forth in claim 12 wherein said clamp means includes means reacting between said shaft and portions of said frame on opposite sides of said spool to inwardly deflect said frame portions into clamping engagement with said spool.

14. The reel set forth in claim 5 wherein said frame comprises a U-shaped member having a pair of legs and a base member spanning said legs; a hand grippable handle mounted on said base.

15. The reel set forth in claim 14 wherein said spool includes a shaft journaled on said pair of legs and a hub mounted on said shaft for rotation therewith; and including brake means for releasably locking said spool to inhibit rotation thereof when the reel is not is use comprising clamp means mounted on said frame for movement between an unclamping position and a clamping position in which said spool is clamped to said frame.

16. The reel set forth in claim 15 wherein said clamp means comprises screw means, threadedly received by an outer terminal end of said shaft, rotatable about its axis; and mount means mounting said screw means for movement between an axially outer unlocked position removed from said frame and an axially inward locked position in which said mount means abuts and bears against said frame.

17. The reel set foth in claim 15 further including handle means fixed to the opposite end of said shaft for rotating said spool about its axis to wind said line on said spool.

18. The reel set forth in claim 17 wherein said frame includes a second U-shaped member mounted on said first mentioned U-shaped member and including a pair of legs, spanned by a second base member, coupled to said first mentioned pair of legs; said aperture being provided in said second base member.

* * * * *